US010226807B2

(12) United States Patent
Shinmiya et al.

(10) Patent No.: US 10,226,807 B2
(45) Date of Patent: Mar. 12, 2019

(54) PRESS FORMING METHOD AND METHOD OF MANUFACTURING PRESSED PRODUCT AS WELL AS PRESS FORMING APPARATUS

(71) Applicant: JFE Steel Corporation, Tokyo (JP)

(72) Inventors: Toyohisa Shinmiya, Tokyo (JP); Yuji Yamasaki, Tokyo (JP); Eiji Iizuka, Tokyo (JP)

(73) Assignee: JFE Steel Corporation (JP)

( * ) Notice: Subject to any disclaimer, the term of this patent is extended or adjusted under 35 U.S.C. 154(b) by 141 days.

(21) Appl. No.: 15/120,557

(22) PCT Filed: Feb. 16, 2015

(86) PCT No.: PCT/JP2015/054091
§ 371 (c)(1),
(2) Date: Aug. 23, 2016

(87) PCT Pub. No.: WO2015/125723
PCT Pub. Date: Aug. 27, 2015

(65) Prior Publication Data

US 2017/0014886 A1 Jan. 19, 2017

(30) Foreign Application Priority Data

Feb. 24, 2014 (JP) ..... 2014-033007

(51) Int. Cl.
*B21D 22/26* (2006.01)
*B21D 11/08* (2006.01)
*B21D 22/06* (2006.01)

(52) U.S. Cl.
CPC ..... *B21D 22/26* (2013.01); *B21D 11/08* (2013.01); *B21D 22/06* (2013.01)

(58) Field of Classification Search
CPC ..... B21D 22/06; B21D 22/26; B21D 53/88; B21D 11/08; B21D 11/085
See application file for complete search history.

(56) References Cited

U.S. PATENT DOCUMENTS 6,276,185 B1 8/2001 Owens
2012/0279273 A1 11/2012 Tsuchiya et al.
2013/0104618 A1 5/2013 Daimaru

FOREIGN PATENT DOCUMENTS

CN 102764807 11/2012
JP 2006-116554 5/2006
(Continued)

OTHER PUBLICATIONS

Chinese Office Action dated Apr. 5, 2017, of corresponding Chinese Application No. 201580010003.6, along with a Search Report in English.

(Continued)

*Primary Examiner* — Debra Sullivan
(74) *Attorney, Agent, or Firm* — DLA Piper LLP (US)

(57) ABSTRACT

A press forming method includes portions of a blank corresponding to straight portions of product is press formed to a hat or channel cross-sectional shape prior to a portion of the blank corresponding to a curved portion of the product at an approached state of the both ends to thereby leave a surplus in a length of the portion of the blank corresponding to the curved portion of the product as compared to a length of the curved portion; then the portion of the blank corresponding to the curved portion of the product is press formed to a longitudinal curved shape at a state of leaving the surplus while forming the hat or channel cross-sectional shape to thereby apply a longitudinal compression stress to the portion of the blank corresponding to curved portion of the product.

5 Claims, 4 Drawing Sheets

(56) References Cited

FOREIGN PATENT DOCUMENTS

| | | | |
|---|---|---|---|
| JP | 2007-021568 | | 2/2007 |
| JP | 2007-222906 | A | 9/2007 |
| JP | 2008-221289 | A | 9/2008 |
| JP | 2009-202189 | A | 9/2009 |
| JP | 2009-248087 | | 10/2009 |
| JP | 2010-120062 | | 6/2010 |
| JP | 2010-207906 | A | 9/2010 |
| JP | 2013-063462 | A | 4/2013 |
| WO | 2011/148880 | A1 | 12/2011 |

OTHER PUBLICATIONS

Supplementary European Search Report dated Jul. 24, 2017, of corresponding European Application No. 15752150.1.
Korean Office Action dated Sep. 26, 2017, of corresponding Korean Application No. 10-2016-7022137 along with a Concise Statement of Relevance of Office Action in English.

PRESS FORMING METHOD AND METHOD OF MANUFACTURING PRESSED PRODUCT AS WELL AS PRESS FORMING APPARATUS

TECHNICAL FIELD

This disclosure relates to a press forming of a metal plate into a product of a hat or channel cross-sectional shape and, more particularly, to a press forming method for a product having a longitudinally curved shape viewing from a vertical wall direction (from a side) and a method of manufacturing the same as a pressed product as well as a press forming apparatus, or a press forming mold used in these methods.

BACKGROUND

In the press forming of the metal plate, spring-back deformation is caused in a pressed product released from the mold due to elastic recovery, which is a problem for dimensional accuracy of a product. Recently, the use of thin-walled, high-tensile steel sheets or aluminum alloy plates is particularly increasing in automobile constructional products for achieving weight reduction of a vehicle body. These materials are large in the spring-back deformation so that defect of the dimensional accuracy is actualized.

The defect of the dimensional accuracy in the cross-section of the product includes an angle change of a vertical wall, a wall warp, and distortion, bending and camber-back as a whole of the product. There have been proposed a great number of countermeasures against each of these defect phenomena. The camber-back is a bad phenomenon that a curved shape in a product having a curve in its longitudinal direction is returned back after press forming, or a radius of curvature is made larger as compared to a target radius of curvature. The camber back is significantly caused in products being low in the wall height and small in the section stiffness.

As a countermeasure for the camber back in a product having a hat cross-sectional shape, for example, JP-A-2013-063462 discloses a technique of suppressing the camber back by making the height of a vertical wall smaller than a difference between a radius of curvature in a hat head portion and a radius of curvature in a flange portion. However, that technique cannot be applied to all of product shapes because there is a restriction in the product shape.

Also, JP-A-2010-207906 discloses a technique of suppressing the camber back by deforming a top portion of an arc-like curved part into a concave shape in an anti-bulging direction under pressure on the way of the press forming to decrease residual tensile stress in the top portion. In that technique, however, the concave shape is formed in the top portion of the arc-like curved part as shown in examples so that the product shape is restricted, but also a shape-correcting process such as subsequent restriking step is required when the concave shape is unnecessary.

In the conventional techniques, it is obliged to restrict the product shape to suppress the camber back as mentioned above. Therefore, it could be helpful to provide a press forming method capable of suppressing camber back in products having a hat or channel cross-sectional shape and a longitudinally curved shape viewing from a vertical wall direction (from a side) and a method of manufacturing a pressed product as well as a press forming apparatus, or a press forming mold used in these methods.

SUMMARY

We discovered a press forming method and a press forming apparatus wherein a blank having a length somewhat longer than a longitudinal length along a curved portion of a product shape is used and compression stress is introduced into only a curvature portion being a main factor of camber back and found that the camber back can be largely suppressed by press forming with them.

That is, we provide a method of press forming a product having a hat or channel cross-sectional shape and a longitudinal shape with a curved portion in its intermediate portion and straight portions adjacent to both sides thereof from a blank, wherein both ends of a blank having a length longer than a length along a longitudinal direction of a product to be formed are first approached to each other up to a distance between both ends of the product to be formed;

portions of the blank corresponding to the straight portions of the product to be formed are restrained while being press formed to a hat or channel cross-sectional shape prior to a portion of the blank corresponding to the curved portion of the product to be formed at an approached state of the both ends to thereby leave a surplus in a length of the portion of the blank corresponding to the curved portion of the product to be formed as compared to a length of the curved portion;

the portion of the blank corresponding to the curved portion of the product to be formed is press formed to a longitudinal curved shape at a state of leaving the surplus while forming the hat or channel cross-sectional shape to thereby apply a longitudinal compression stress to the portion of the blank corresponding to the curved portion of the product to be formed.

Also, we provide a method of manufacturing a pressed product by press forming a product having a hat or channel cross-sectional shape and a longitudinal shape with a curved portion in its intermediate portion and straight portions adjacent to both sides thereof from a blank, wherein both ends of a blank having a length longer than a length along a longitudinal direction of a product to be formed are first approached to each other up to a distance between both ends of the product to be formed;

portions of the blank corresponding to the straight portions of the product to be formed are restrained while being press formed to a hat or channel cross-sectional shape prior to a portion of the blank corresponding to the curved portion of the product to be formed at an approached state of the both ends to thereby leave a surplus in a length of the portion of the blank corresponding to the curved portion of the product to be formed as compared to a length of the curved portion;

the portion of the blank corresponding to the curved portion of the product to be formed is press formed to a longitudinal curved shape at a state of leaving the surplus while forming the hat or channel cross-sectional shape to thereby apply a longitudinal compression stress to the portion of the blank corresponding to the curved portion of the product to be formed.

Furthermore, we provide a press forming apparatus used in press forming of a product having a hat or channel cross-sectional shape and a longitudinal shape with a curved portion in its intermediate portion and straight portions adjacent to both sides thereof from a blank, characterized by comprising opposite upper die and lower die, wherein the lower die comprises a blank holding part for positioning both ends of a blank having a length longer than a length along a longitudinal direction of a product to be formed at a state of approaching them to each other up to a distance between both ends of the product to be formed;

one of the upper die and the lower die has a forming part of a shape corresponding to a shape of the product to be formed;

the other of the upper die and the lower die has a forming part of a shape corresponding to the shape of the product to be formed and a forming part divided into a curved portion and straight portions adjacent to both sides thereof;

the straight portions of the forming part are approached to the former one of the upper die and the lower die as compared to the curved portion of the forming part to start the forming of the blank prior to the curved portion of the forming part and held at a state capable of pushing in association with reaction force.

According to the press forming method and method of manufacturing a pressed product, when a product having a hat or channel cross-sectional shape and a longitudinal shape with a curved portion in its intermediate portion and straight portions adjacent to both sides thereof is press formed from a blank, both ends of a blank having a length longer than a length along a longitudinal direction of a product to be formed are first approached to each other up to a distance between both ends of the product to be formed, and thereafter portions of the blank corresponding to the straight portions of the product to be formed are restrained while being press formed to a hat or channel cross-sectional shape prior to a portion of the blank corresponding to the curved portion of the product to be formed at an approached state of the both ends to thereby leave a surplus in a length of the portion of the blank corresponding to the curved portion of the product to be formed as compared to a length of the curved portion, and then the portion of the blank corresponding to the curved portion of the product to be formed is press formed to a longitudinal curved shape at a state of leaving the surplus while forming the hat or channel cross-sectional shape to thereby apply a longitudinal compression stress to the portion of the blank corresponding to the curved portion of the product to be formed so that tensile stress in the longitudinal direction of the curved portion of the formed product is not retained substantially or fully after the press forming by offsetting with the compression stress and hence the occurrence of camber back resulting from the tensile stress in the longitudinal direction can be prevented effectively even in products being low in the wall height and small in the section stiffness, and it is possible to form a product having a hat or channel cross-sectional shape and a longitudinal shape with a curved portion in its intermediate portion and straight portions adjacent to both sides thereof in a good dimension accuracy without restricting the product shape.

In the press forming apparatus, the blank holding part of the lower die in the opposite upper die and lower die positions the both ends of the blank having a length longer than a length along a longitudinal direction of a product to be formed at a state of approaching them to each other up to a distance between both ends of the product to be formed, and a product having a hat or channel cross-sectional shape and a longitudinal shape with a curved portion in its intermediate portion and straight portions adjacent to both sides thereof is press formed from the blank having the positioned both ends by cooperation of the lower die and upper die through approach movement between the forming part of the shape in one of them and the forming part of the shape in the other corresponding to the shape of the product to be formed to each other.

In this case, the forming part of the latter one of the upper die and the lower die is divided into a curved portion and straight portions adjacent to both sides thereof, and the straight portions are approached to the former one of the upper die and lower die as compared to the curved portion of the forming part and held at a state capable of pushing in association with reaction force and co-worked with the straight portion of the forming part in the former one of the upper die and lower die to start the forming of the blank prior to the curved portion of the forming part, whereby the portions of the blank corresponding to the straight portions of the product to be formed is restrained while being press formed to a hat or channel cross-sectional shape to thereby leave a surplus in the length of the portion of the blank corresponding to the curved portion of the product to be formed as compared to the length of the curved portion. Then, the curved portion of the forming part in the latter one of the lower die and upper die is co-worked with the curved portion of the forming part in the former one of the upper die and lower die, whereby the portion of the blank corresponding to the curved portion of the product to be formed is press formed to a longitudinal curved shape while forming the hat or channel cross-sectional shape to apply compression stress in the longitudinal direction to such a portion of the blank.

The holding capable of pushing in association with reaction force includes holding with an elastic member such as metal spring, rubbery elastomer or the like and a blank is held with a hydraulic, pneumatic or hydraulic-pneumatic cushion device of a press machine, a gas spring or the like and pushed to a backward limit position associated with moving down of the upper die while applying reaction force to pushing force of the opposing die and returned to original position associated with moving up of the upper die.

Therefore, compression stress in the longitudinal direction is applied to the portion of the blank corresponding to the curved portion of the product to be formed so that tensile stress in the longitudinal direction of the curved portion of the formed product after the press forming is not retained substantially or completely by offsetting with the compression stress. Hence, the occurrence of camber back resulted from the tensile stress in the longitudinal direction can be prevented effectively even in the products being low in the wall height and small in the section stiffness, and it is possible to form a product having a hat or channel cross-sectional shape and a longitudinal shape with a curved portion in its intermediate portion and straight portions adjacent to both sides thereof in a good dimension accuracy without restricting the product shape.

Moreover, in the press forming method and the method of manufacturing a pressed product as well as the press forming apparatus, when the longitudinal length L of the blank exceeds 1.05 times of a length L0 along the longitudinal direction of the product to be formed, the possibility of buckling due to compression stress becomes higher so that the longitudinal length L of the blank is preferable to be larger than the length L0 along the longitudinal direction of the product to be formed and smaller than $1.05 \times L0$ or equal to $1.05 \times L0$, i.e., $L0 < L \leq 1.05 \times L0$.

DETAILED DESCRIPTION

Figure 1:
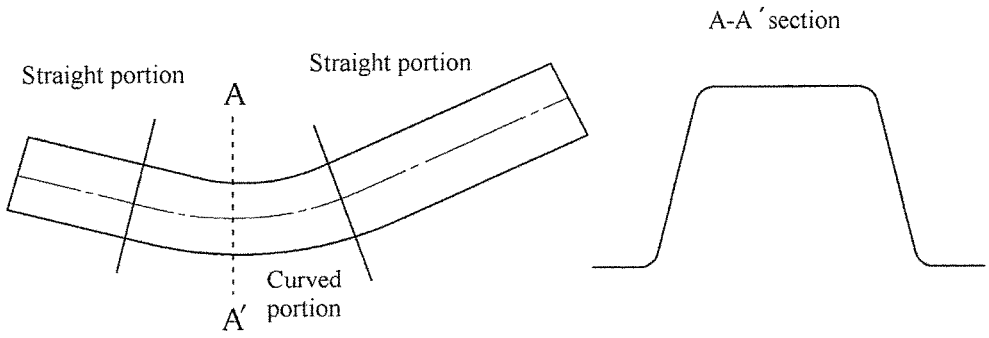
FIG. 1 is a side view schematically illustrating a typical shape of a product applied by the press forming method and the method of manufacturing a pressed product as well as the press forming apparatus and a cross-section view at a position A-A' thereof.
Figure 2:
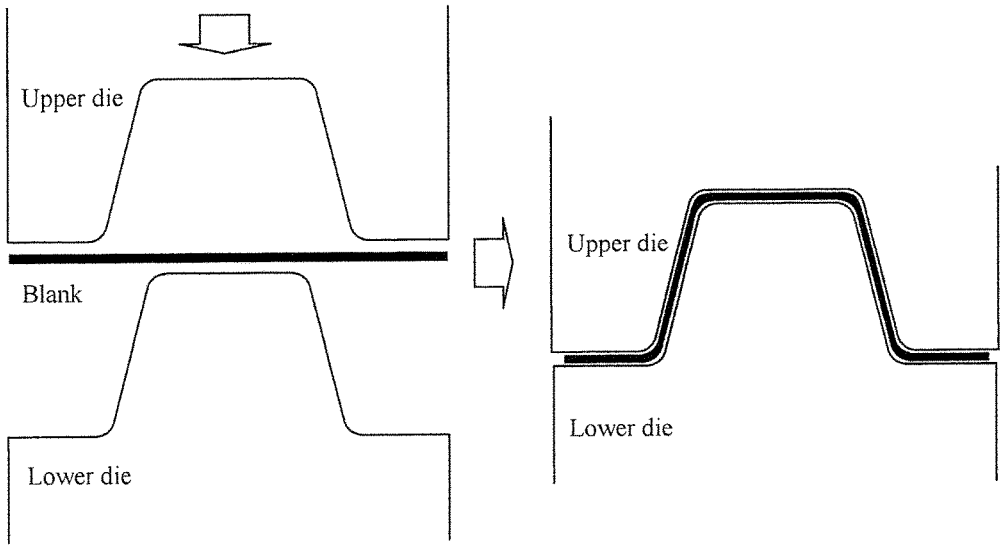
FIG. 2 is a cross-section view schematically illustrating an example of the conventional press forming mold for press forming the above product shape.
Figure 3:
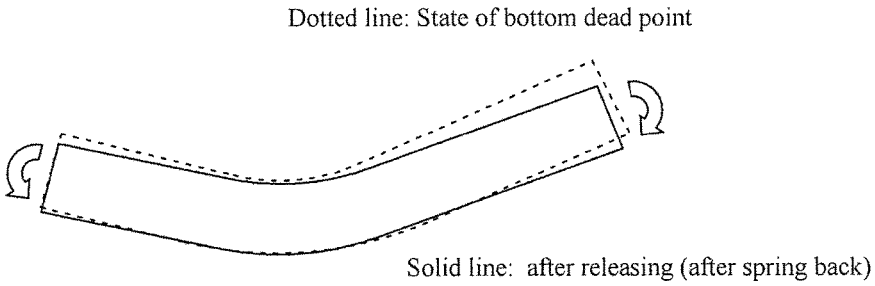
FIG. 3 is a view schematically illustrating camber back of a curved product press formed by the conventional method with the above press forming mold.

When a product having generally a hat or a channel cross-sectional shape and being curved in a longitudinal direction as shown in FIG. 1 is press formed from a flat blank with a press forming mold comprised of an upper die and a lower die of a shape corresponding to a product shape as shown in FIG. 2, tensile stress is generated in an outside of a curved portion in the longitudinal direction of the product and compression stress is generated in an inside thereof and hence residual bending moment is generated to mitigate a difference between these stresses, whereby there is generated a phenomenon called as camber back that a radius of curvature of a curved portion after the releasing from the mold as shown by a solid line becomes larger with respect to a formed shape shown by dotted lines at a bottom dead point of the upper die as shown in FIG. 3. This phenomenon is a type of spring back deformation, and a return quantity thereof becomes larger in a steel sheet as a strength of the steel sheet becomes higher.

As a method of reducing camber back is considered a method wherein compression stress is applied to a portion of generating tensile stress in the outside of the curved portion to decrease residual bending moment. Our press forming method and press forming apparatus, or a press forming mold is capable of applying compression stress to only a portion requiring application of compression stress, or a curved portion.

Figures 4A, 4B, 4C:
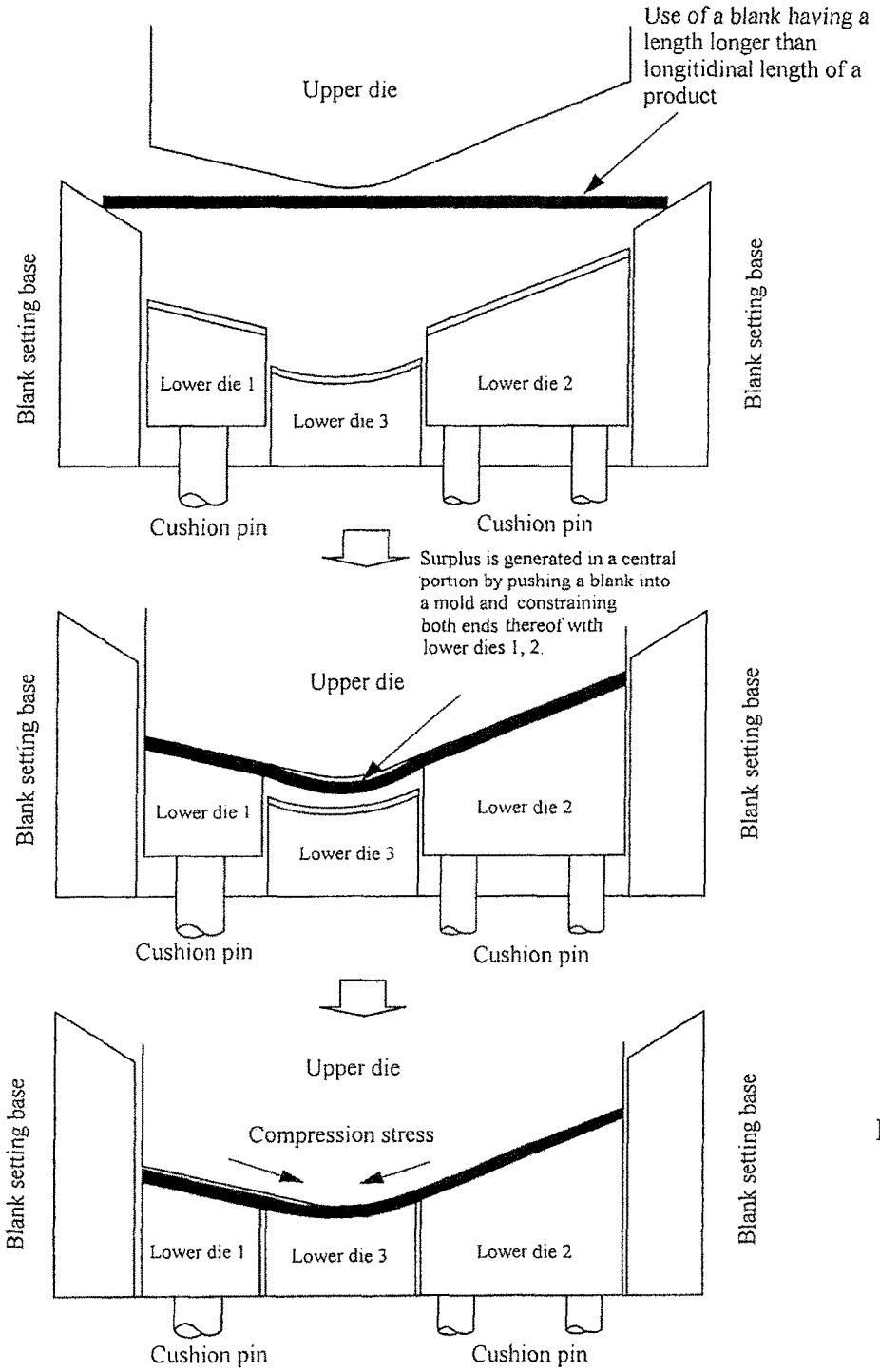
FIG. 4 is a longitudinal section view schematically illustrating a construction of a press forming mold in an example of the press forming apparatus that carries out an example of the press forming method and the method of manufacturing a pressed product, wherein FIG. 4(*a*), FIG. 4 (*b*) and FIG. 4(*c*) show a state of a blank before forming, during forming and at the end of forming (at bottom dead point of upper die), respectively.

An example will be described in detail with reference to the drawings below. FIG. 4 is a longitudinal section view schematically illustrating a construction of a press forming mold in an example of the press forming apparatus that carries out an example of the press forming method and the method of manufacturing a pressed product, wherein FIG. 4(*a*), FIG. 4(*b*) and FIG. 4(*c*) show a state of a blank before forming, during forming and at the end of forming (at bottom dead point of upper die), respectively.

The press forming mold of this example forms a product having a curved portion in its intermediate portion and straight portions adjacent to both sides thereof along a longitudinal direction and a hat cross-sectional shape as a side shape is shown in a left side of FIG. 1 and an A-A' section (cross-section) is shown in a right side thereof. Therefore, a cross-sectional shape of a forming portion in an upper die and a lower die constituting the press forming mold of this example has a hat form corresponding to the cross-sectional shape of the product as shown in FIG. 2.

The press forming mold of this example comprises opposite upper die and lower die and a blank setting base adjacent to the lower die. The lower die is divided into a lower die segment 3 corresponding to a curved portion of a product and lower die segments 1, 2 corresponding to straight portions adjacent to both sides of the curved portion of the product. The lower die segments 1, 2 corresponding to the straight portions are held by cushion pins connected to a cushion device of a usual press machine (not shown) mounting the above press forming mold at a state capable of pushing in association with reaction force. In the example shown in FIG. 4, the lower die segments 1, 2 have a structure supported by the cushion pin(s), but may have a structure supported by a metal spring, a gas spring or the like.

The press forming mold of this example is operated as follows. At first, the blank setting bases and the lower die segment 3 are attached to a bolster of the press machine through a base plate (not shown) and the upper die is attached to a slide of the press machine, wherein the upper die can be elevated to the lower die segments 1, 2, 3 by an elevating actuation of the slide.

Also, the lower die segments 1, 2 are uplifted and supported by cushion pins connected to a cushion device of the press machine and passing through the bolster. After the upper die is elevated upward by the slide, a flat blank is placed on the blank setting bases as shown in FIG. 4(*a*).

A face of the blank setting base placing the blank is preferable to be declined from a side view to facilitate pushing of the blank to the blank setting base. And also, to apply compression stress to the blank, it is necessary that a longitudinal length L of the blank used is longer than a longitudinal length L0 along a curve of a bottom in a hat shape of a product. However, if the length is too long, buckling is caused so that it is $L0<L\leq1.05\times L0$.

After the blank is placed on the blank setting base, the upper die is lowered by the slide of the press machine to push the blank between the blank setting bases. Thereafter, both end portions of the blank are formed by the upper die and the lower die segments 1 and 2 to correspond to straight portions of the product as shown in FIG. 4(*b*). In this regard, a material surplus in the longitudinal direction is generated in an intermediate portion of the blank (portion above the lower die segment 3) corresponding to a curved portion of the product. Then, as shown in FIG. 4(*c*), the intermediate portion of the blank generating the material surplus is formed into a curved portion of the product by the upper die and the lower die segment 3 while clipping the both end portions of the blank with the upper die and the lower die segments 1 and 2. Thus, compression stress can be applied to the curved portion of the product to be formed in the longitudinal direction.

According to the press forming mold and the press forming method of this example using the same and the method of manufacturing a pressed product, therefore, compression stress in the longitudinal direction is applied to the portion of the blank corresponding to the curved portion of the product to be formed so that tensile stress in the longitudinal direction is not retained substantially or completely in the curved portion of the formed product, or the pressed product by offsetting with the above compression stress after the press forming and hence the occurrence of camber back resulted from tensile stress in the longitudinal direction can be effectively prevented even in products being low in the wall height and small in the section stiffness, and it is possible to form a product having a hat cross-sectional shape and a longitudinal curved shape comprised of a curved portion in its intermediate part and straight portions adjacent to both sides thereof in a good dimensional accuracy without restricting the product shape.

Figure 5A:
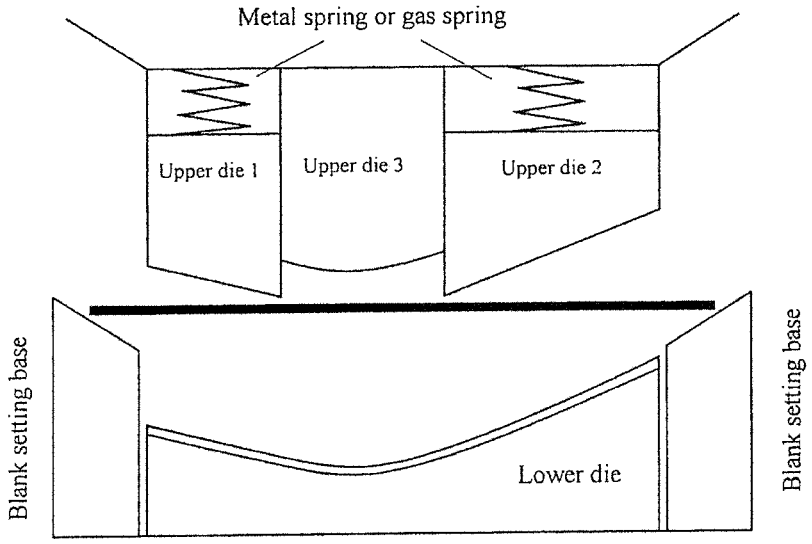
FIG. 5 is a longitudinal section view schematically illustrating a construction of a press forming mold in another example of the press forming apparatus that carries out another example of the press forming method and the method of manufacturing a pressed product, wherein FIG. 5(*a*), FIG. 5(*b*) and FIG. 5(*c*) show a state of a blank before forming, during forming and at the end of forming (at bottom dead point of upper die), respectively.
Figure 5B:
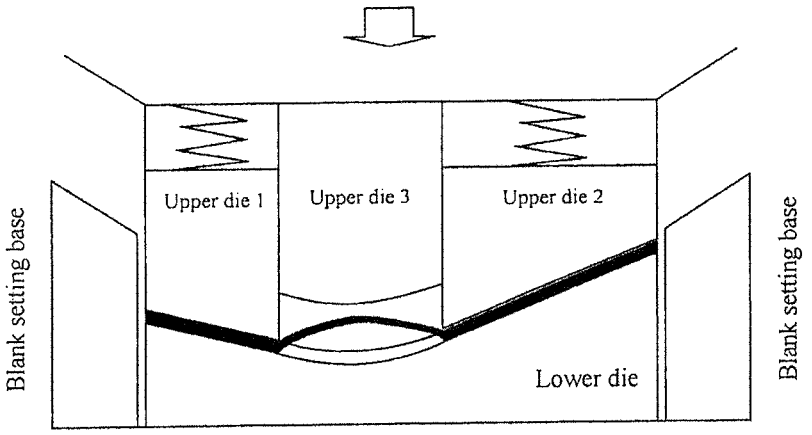
Figure 5C:
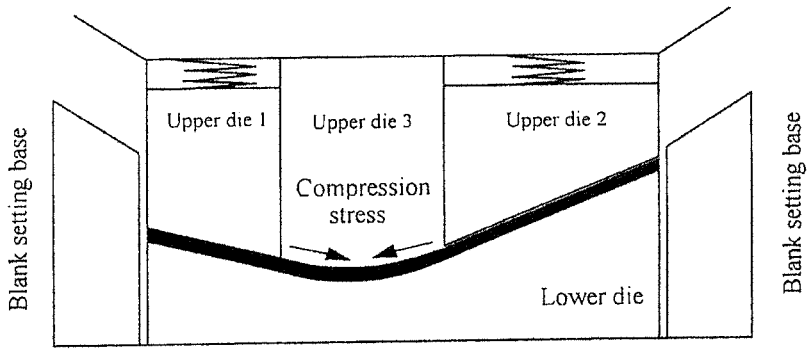

FIG. 5 is a longitudinal section view schematically illustrating a construction of a press forming mold having a divided upper die different from the previous example in another example of the press forming apparatus that carries out another example of the press forming method and the method of manufacturing a pressed product, wherein FIG. 5(*a*), FIG. 5(*b*) and FIG. 5(*c*) show a state of a blank before forming, during forming and at the end of forming (at bottom dead point of upper die), respectively.

The press forming mold of this example has the same fundamental thinking as described in the previous example, but has a structure that the upper die is divided into upper die segments 1, 2 corresponding to the straight portions of the product and upper die segment 3 corresponding to the curved portion of the product and a metal spring or a gas spring holding the material at a state capable of pushing in association with reaction force is incorporated into each of the upper die segments 1, 2 corresponding to the straight portions of the product.

When a product having a shape as shown in FIG. 1 is press formed with the press forming mold of this example, after the press forming mold is attached to a press machine similarly in the previous example, a flat blank is placed on blank setting bases as shown in FIG. 5(*a*) and then the blank is pushed between the blank setting bases with the upper die segments 1 and 2 to perform the forming of the both end portions of the blank corresponding to the straight portions of the product with the lower die and the upper die segments 1 and 2 as shown in FIG. 5(*b*). In this regard, a material surplus in the longitudinal direction is generated in an intermediate portion of the blank corresponding to the curved portion of the product. Thereafter, as shown in FIG. 5(*c*), the intermediate portion is formed by the lower die and the upper die segment 3, whereby compression stress can be applied to the curved portion of the product to be formed in the longitudinal direction.

According to the press forming mold and the press forming method of this example using the same and the method of manufacturing a pressed product, therefore, compression stress in the longitudinal direction is applied to the portion of the blank corresponding to the curved portion of the product to be formed so that tensile stress in the longitudinal direction is not retained substantially or completely in the curved portion of the formed product, or the pressed product by offsetting with the above compression stress after the press forming and hence the occurrence of camber back resulted from tensile stress in the longitudinal direction can be prevented effectively even in products being low in the wall height and small in the section stiffness, and it is possible to form a product having a hat cross-sectional shape and a longitudinal curved shape comprised of a curved portion in its intermediate part and straight portions adjacent to both sides thereof in a good dimensional accuracy without restricting the product shape.

In the examples shown in FIGS. 4 and 5, the portions of the blank corresponding to the straight portions of the product are not necessary to be completely formed at an initial stage of the forming. It is enough to restrain the portions corresponding to the straight portions during the forming of the portion of the blank corresponding to the curved portion of the product.

Although the above is described with reference to the illustrated examples, our methods and apparatus are not limited to these examples and may be properly modified within the scope of the appended claims, if necessary. For example, the cross-sectional shape of the product may be a channel shape having no flange portion instead of the hat shape having flange portions.

Even if the lower die is divided in the press forming mold, the lower die segments corresponding to the straight portions of the product may be held by a metal spring, a gas spring or the like instead of the cushion device.

INDUSTRIAL APPLICABILITY

Thus, according to the press forming method and the method of manufacturing a pressed product as well as the press forming apparatus, compression stress in the longitudinal direction is applied to the portion of the blank corresponding to the curved portion of the product to be formed so that tensile stress in the longitudinal direction is not retained substantially or completely in the curved portion of the formed product, or the pressed product by offsetting with the above compression stress after the press forming and hence the occurrence of camber back resulted from tensile stress in the longitudinal direction can be prevented effectively even in products being low in the wall height and small in the section stiffness, and it is possible to form a product having a hat cross-sectional shape or a channel cross-sectional shape and a longitudinal curved shape comprised of a curved portion in its intermediate part and straight portions adjacent to both sides thereof in a good dimensional accuracy without restricting the product shape.

The invention claimed is:

1. A method of press forming a product having a hat or channel cross-sectional shape and a longitudinal shape with a curved portion in an intermediate portion and straight portions adjacent to both sides of the curved portion from a blank comprising:

providing a blank having a length longer than a length along a longitudinal direction of the product to be formed;

positioning the blank in an approached state by causing both ends of the blank to approach each other up to a distance between both ends of the product to be formed;

restraining portions of the blank corresponding to the straight portions of the product to be formed while press forming the hat or channel cross-sectional shape prior to press forming a portion of the blank corresponding to a curved portion of the product to be formed at the approached state of the both ends, thereby leaving a surplus in a length of the portion of the blank corresponding to the curved portion of the product to be formed as compared to a length of the curved portion of the product to be formed;

press forming the portion of the blank corresponding to the curved portion of the product to be formed to a longitudinal curved shape at a state of leaving the surplus while forming the hat or channel cross-sectional shape, thereby applying a longitudinal compression stress to the portion of the blank corresponding to the curved portion of the product to be formed.

2. The method according to claim 1, wherein a longitudinal length L of the blank is larger than a length L0 along the longitudinal direction of the product to be formed and smaller than 1.05×L0 or equal to 1.05×L0.

3. A press forming apparatus used in press forming of a product having a hat or channel cross-sectional shape and a longitudinal shape with a curved portion in an intermediate portion and straight portions adjacent to both sides of the curved portion from a blank, comprising an opposite upper die and lower die, wherein the lower die comprises a blank holding part for positioning both ends of a blank having a length longer than a length along a longitudinal direction of the product at a state of approaching each other up to a distance between both ends of the product;

one of either the upper die or the lower die has a forming part of a shape corresponding to a shape of the product to be formed;

the other of the upper die or the lower die has a forming part of a shape corresponding to the shape of the product and the forming part divided into a curved portion and straight portions adjacent to both sides thereof;

the straight portions of the forming part are approached to the former one of the upper die and the lower die as compared to the curved portion of the forming part so as to start the forming of the blank prior to the curved portion of the forming part and held at a state capable of pushing in association with a reaction force.

4. The press forming apparatus according to claim 3, wherein the upper die has the forming part of a shape corresponding to the shape of the product;

the lower die has the forming part of a shape corresponding to the shape of the product and the forming part divided into a curved portion and straight portions adjacent to both sides thereof;

the straight portions in the forming part of the lower die are approached to the upper die as compared to the curved portion in the forming part of the lower die so as to start the forming of the blank prior to the curved portion in the forming part of the lower die and held at a state capable of pushing with a cushion device.

5. The press forming apparatus according to claim 3, wherein the lower die has the forming part of a shape corresponding to the shape of the product;

the upper die has the forming part of the shape corresponding to the shape of the product and the forming part divided into a curved portion and straight portions adjacent to both sides thereof;

the straight portions in the forming part of the upper die are approached to the lower die as compared to the curved portion in the forming part of the upper die so as to start the forming of the blank prior to the curved portion in the forming part of the upper die and held at a state capable of pushing with an elastic member.

* * * * *